US011408130B2

(12) United States Patent
Blanc et al.

(10) Patent No.: US 11,408,130 B2
(45) Date of Patent: Aug. 9, 2022

(54) SWITCH ELEMENT FOR A TRACK CARRYING A RUBBER-TYRED VEHICLE, TRACK SWITCHGEAR MADE FROM SAID ELEMENTS AND METHOD FOR TRANSPORTING PASSENGERS ALONG A RAIL PROVIDED WITH SUCH SWITCHGEAR

(71) Applicant: POMA, Voreppe (FR)

(72) Inventors: Eric Blanc, Bourgoin-Jallieu (FR); Alain Mollet, Annecy le Vieux (FR)

(73) Assignee: POMA, Voreppe (FR)

( * ) Notice: Subject to any disclaimer, the term of this patent is extended or adjusted under 35 U.S.C. 154(b) by 212 days.

(21) Appl. No.: 16/482,450

(22) PCT Filed: Jan. 31, 2018

(86) PCT No.: PCT/EP2018/052422
§ 371 (c)(1),
(2) Date: Jul. 31, 2019

(87) PCT Pub. No.: WO2018/141803
PCT Pub. Date: Aug. 9, 2018

(65) Prior Publication Data

US 2020/0024807 A1 Jan. 23, 2020

(30) Foreign Application Priority Data

Jan. 31, 2017 (FR) ..... 1750805

(51) Int. Cl.
*E01B 7/14* (2006.01)
*E01B 25/12* (2006.01)

(52) U.S. Cl.
CPC ..... *E01B 7/14* (2013.01); *E01B 25/12* (2013.01)

(58) Field of Classification Search
CPC ..... E01B 7/00; E01B 7/02; E01B 7/04; E01B 7/08; E01B 7/10; E01B 7/14; E01B 7/18;
(Continued)

(56) References Cited

U.S. PATENT DOCUMENTS 1,585,537 A * 5/1926 Davis ..... E01B 7/14 246/386
2,997,004 A * 8/1961 Roseubaum ..... E01B 25/12 104/130.11
(Continued)

FOREIGN PATENT DOCUMENTS

CN 102787536 A 11/2012
DE 1 042 625 B 11/1958
(Continued)

OTHER PUBLICATIONS

International Search Report (PCT/ISA/210) dated May 8, 2018, by the European Patent Office as the International Searching Authority for International Application No. PCT/EP2018/052422. (7 pages).
(Continued)

*Primary Examiner* — Zachary L Kuhfuss
*Assistant Examiner* — Cheng Lin
(74) *Attorney, Agent, or Firm* — Buchanan Ingersoll & Rooney PC

(57) ABSTRACT

The disclosure relates to a flexible switch element for a track carrying rubber-tyred trains comprising two parallel rails each having an upper running surface for the tyres and an inner side surface for supporting a continuous strip (B) for guiding the train. The switch element has at least one hinge providing the longitudinal link with an adjacent switch element. The switch element also has a set of longitudinal abutments engaging, on the one hand, with the hinge in order to adjust the relative angular orientation of the element and, on the other hand, with a pivoting bottom rod providing the
(Continued)

connection to and the alignment with an identical switch element arranged symmetrically on the opposite side of the switch. The disclosure also relates to a track switchgear comprising the assembly of such elements and a method for transporting passengers along a track provided with said track switchgear.

10 Claims, 4 Drawing Sheets

(58) Field of Classification Search
CPC ..... E01B 7/20; E01B 7/28; E01B 7/06; E01B 25/00; E01B 25/12; E01B 25/15; E01B 23/06
USPC ..... 246/415 R, 430, 442, 443, 453
See application file for complete search history.

(56) References Cited

U.S. PATENT DOCUMENTS 3,093,090 A * 6/1963 Rosenbaum ..... E01B 25/12 104/130.11
4,094,252 A * 6/1978 Pater ..... E01B 25/12 104/130.01
5,020,442 A 6/1991 Burg et al.
5,219,395 A * 6/1993 Spieldiener ..... E01B 25/12 104/102
5,287,811 A * 2/1994 Matsuura ..... E01B 25/00 104/130.03
6,279,484 B1 8/2001 Shaw
6,332,406 B1 * 12/2001 Mugnier ..... E01B 25/12 104/130.01
2005/0172850 A1 8/2005 Sakita

FOREIGN PATENT DOCUMENTS

DE 1 118 244 B 11/1961
DE 1118244 B * 11/1961 ..... E01B 25/12
DE 197 08 389 A1 9/1998
JP 2011-122387 A 6/2011

OTHER PUBLICATIONS

Written Opinion (PCT/ISA/237) dated May 8, 2018, by the European Patent Office as the International Searching Authority for International Application No. PCT/EP2018/052422. (6 pages).

* cited by examiner

SWITCH ELEMENT FOR A TRACK CARRYING A RUBBER-TYRED VEHICLE, TRACK SWITCHGEAR MADE FROM SAID ELEMENTS AND METHOD FOR TRANSPORTING PASSENGERS ALONG A RAIL PROVIDED WITH SUCH SWITCHGEAR

CROSS REFERENCE TO RELATED APPLICATIONS

This application is a U.S. National Stage application under 35 U.S.C. § 371 of International Patent Application No. PCT/EP2018/052422 filed on Jan. 31, 2018, which claims priority to French Patent Application No. 1750805 filed on Jan. 31, 2017, the entire contents of both of which are incorporated herein by reference in their entireties for all purposes.

The invention relates to a switch element for a track carrying a rubber-tyred vehicle, a track switchgear comprising the assembly of such elements and a method for transporting passengers along a rail provided with said switchgear.

TECHNICAL FIELD OF THE INVENTION

The invention relates to installations for passenger transport by means of vehicles or trains or wheeled trains of the APM (Automated People Mover)-type towed by means of a motorized cable. These trains run between stations on a track consisting of two rails made up of parallel longitudinal profiles with an H-shaped cross-section providing running surfaces for the tyres. In these installations, the track is duplicated outside the stations via switches.

Flexible switches such as those described already exist, for example, in JP 2011 122387A. These switches are made up of switch rails comprising a set of profile elements connected through hinges. The respective side faces of these elements are provided with a longitudinally deformable continuous strip on which a rotating member carried by the towed vehicles comes into dynamic contact, in order to ensure their lateral guidance along the track.

These switch rails enable adaptation to different track curves, thanks to the profile element hinges and the bending of the continuous guide strip.

However, this embodiment is intended for a single track in the form of a concrete monorail.

On the other hand, the invention seeks to equip tracks consisting of two parallel rails with a flexible switch and one of the problems encountered is to synchronize and coordinate the rotational movement and changes in curvature of the two assembly lines of the elements forming the rails.

SUMMARY OF THE INVENTION

The invention aims to remedy this technical problem by seeking to improve existing flexible switches and ensure their reliable and safe adaptation to double H-shaped rail tracks.

This is achieved by means of a flexible switch element for a track carrying a rubber-tyred train comprising two parallel rails, each having an upper running surface for the tyres and an inner side surface for supporting a continuous strip for guiding the train, with said switch element having at least one hinge providing the longitudinal link with an adjacent switch element, characterized in that said switch element further has a set of longitudinal abutments engaging, on the one hand, with said hinge in order to adjust the relative angular orientation of said element and, on the other hand, with a pivoting bottom rod providing the connection to and alignment with an identical switch element arranged symmetrically on the opposite side of the switch.

According to an advantageous characteristic, the hinge comprises two bearings projecting on at least one of the longitudinal ends of the element and wherein a vertical axis forming one piece with said rod is engaged.

According to another characteristic, the switch element has a hinge on each of its longitudinal ends.

According to yet another characteristic, the switch element has two cleats for retaining the continuous guide strip, which, with its inner side face, provides an intermediate space wherein the curved part of said strip is placed.

According to a first variant, the set of abutments includes, on a first longitudinal end, a pin of variable length and, on a second longitudinal end, a stud intended to support the pin opposite the adjacent switch element.

According to a specific characteristic, the hinge is mounted between the inner side face and the set of longitudinal abutments extending from the outer side of the upper running face.

Preferably, the hinge is mounted below the level of the upper running face.

According to another characteristic, the outer side face of the switch element has substantially horizontal fins intended to abut against markers arranged on the outer edges of the track.

Another subject-matter of the invention is a flexible track switchgear intended to equip a track crossing, said switchgear consisting of two parallel ties of switch elements according to one of the preceding claims, characterized in that it is provided with two hinged end sections, respectively, on the switch elements at the ends of the ties and ensuring, on the one hand, the alignment and locking of the ties with the crossing guard rails and, on the other hand, the link with devices controlling the pivoting of said ties mounted on the outer edges of the track.

According to a first variant of the track switchgear, each of said end sections is provided with a cavity intended to receive and block the end of the piston rod mounted on the crossing guard rails.

According to another advantageous characteristic, each of said end sections has, on its outer side edge, a pivot with a vertical axis connected to one of the devices controlling the pivoting of the ties.

According to another advantageous feature, each of said end sections has one abutment which engages with the abutments of the end elements of the ties.

In another variant, the track switchgear further comprises a central switch rail rotatively mounted in the axial extension of the crossing core and having a spatulated end branch that alternately aligns with the respective end sections of the two ties.

Yet another subject-matter of the invention is a method for transporting passengers by means of rubber-tyred trains along a track comprising:

two parallel rails each providing an upper surface for running the tyres and an inner side surface for supporting a continuous strip for guiding the train and, at least one crossing equipped with a flexible switch and consisting of ties of switch elements as defined above, characterized in that the switch is pivoted by means of control devices mounted on the edges of the tracks and acting on the end sections of the ties.

The switching elements of the invention have a simple structure which enables an easy assembling and disassembling of the elements, particularly in case of maintenance or replacement of a tie element.

The invention's switchgear made with these switch elements is flexible, reliable and adapts to different track curves without any disadvantageous gaps for the running of rubber-tyred trains.

The invention's switchgear comprises secure locking means and may, in addition, be manufactured in different lengths and, where applicable, be associated with a traditional pivoting central switch rail.

BRIEF DESCRIPTION OF THE FIGURES

Further characteristics and advantages of the invention will emerge from the following description, with reference to the appended figures and explained in details below.

For greater clarity, identical or similar elements are identified by identical reference signs on all figures.

DETAILED DESCRIPTION OF THE EMBODIMENTS

Of course, the embodiments illustrated by the figures presented above and described below are given only as non-exhaustive examples. There is explicit provision for these various embodiments to be combined to propose other ones.

Figure 1:
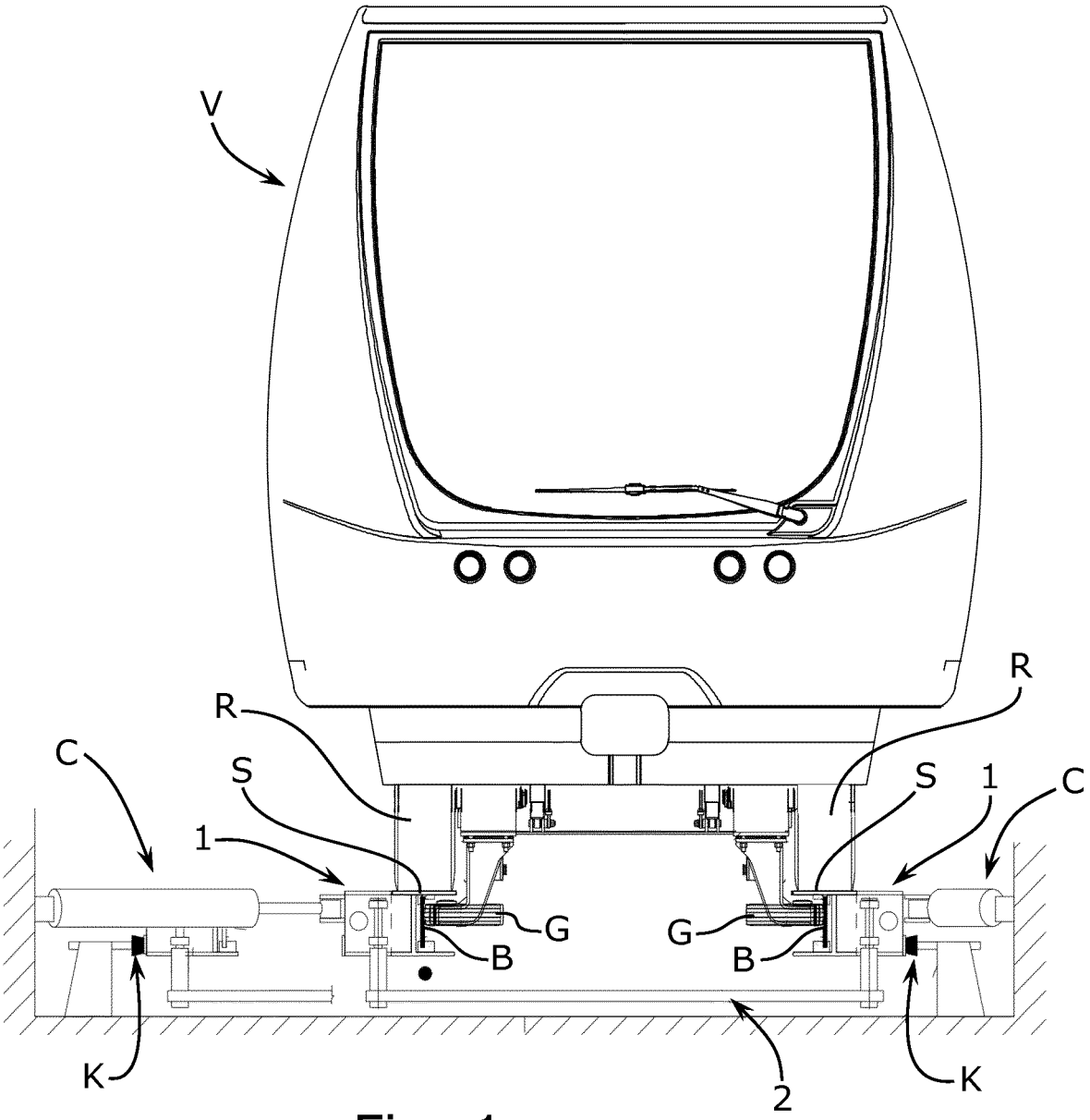
FIG. 1 shows a front view of one embodiment of the track switchgear of the invention, on which a rubber-tyred train circulates.

FIG. 1 shows a switchgear forming a switch intended to equip a railway crossing for the circulation of an APM-type train V the wheels R of which are equipped with tyres and are associated with guide rollers or rollers G.

Figure 3:
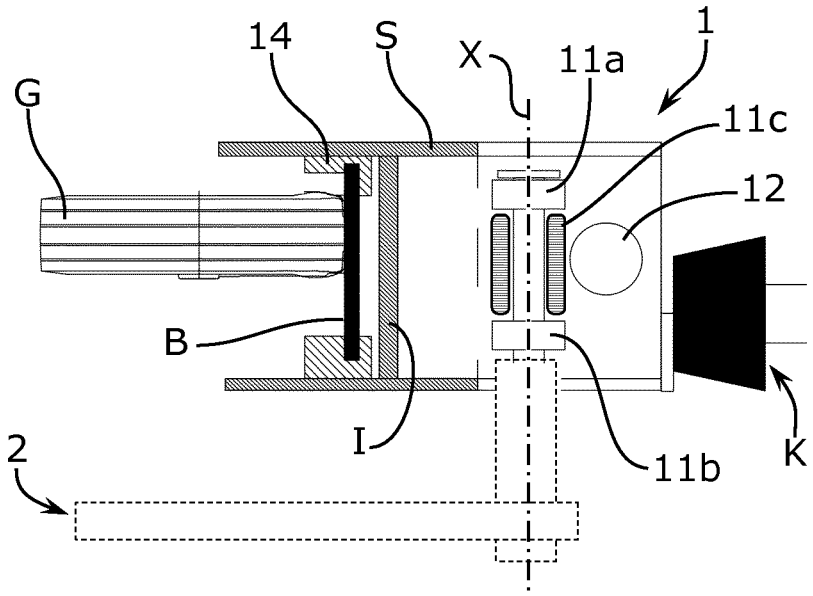
FIG. 3 is a front view of the switch element of FIGS. 2A and 2B.

The two parallel rails delimiting the track consist of longitudinal profiles with an H-shaped cross-section (H lying as shown in FIG. 3), each of which provides an upper surface S for running the tyres and an inner side surface I for supporting a continuous strip B extending substantially vertically and engaging with the rotating rollers G for guiding the train V.

The track switchgear of the invention comprises the assembly of identical switch elements 1 hinged to each other. Thus, each switch element 1 has at least one hinge and, preferably, two hinges providing, on either side, the longitudinal link with adjacent switch elements so as to form two parallel ties of elements by defining a so-called "flexible" switch, as illustrated in FIGS. 5A, 5B and 6A, 6B.

The switchgear also comprises devices C for controlling the pivoting of the ties which are mounted on the outer edges of the track and which will be described below.

Figure 2A:
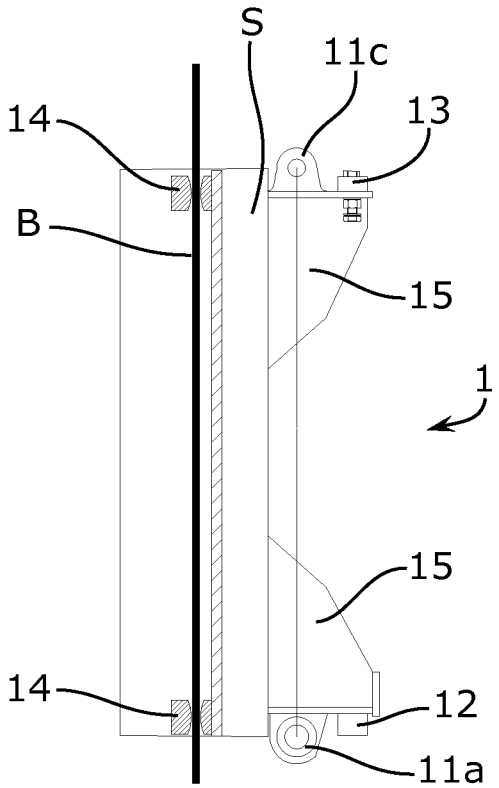
FIGS. 2A and 2B show top views of one embodiment of the switching element of the invention with the continuous guide strip in normal position and in curved position, respectively.

The structure of the switch elements 1 the ties of the invention's track switchgear are made of, will now be described in detail with reference to FIGS. 2A, 2B and 3.

The hinges of the switch elements 1 comprise at least one bearing supported by each of the longitudinal ends of each element. Thus, the switch elements 1 can be connected longitudinally to each other by means of their respective bearings wherein a vertical axis X is engaged.

Figure 4A:
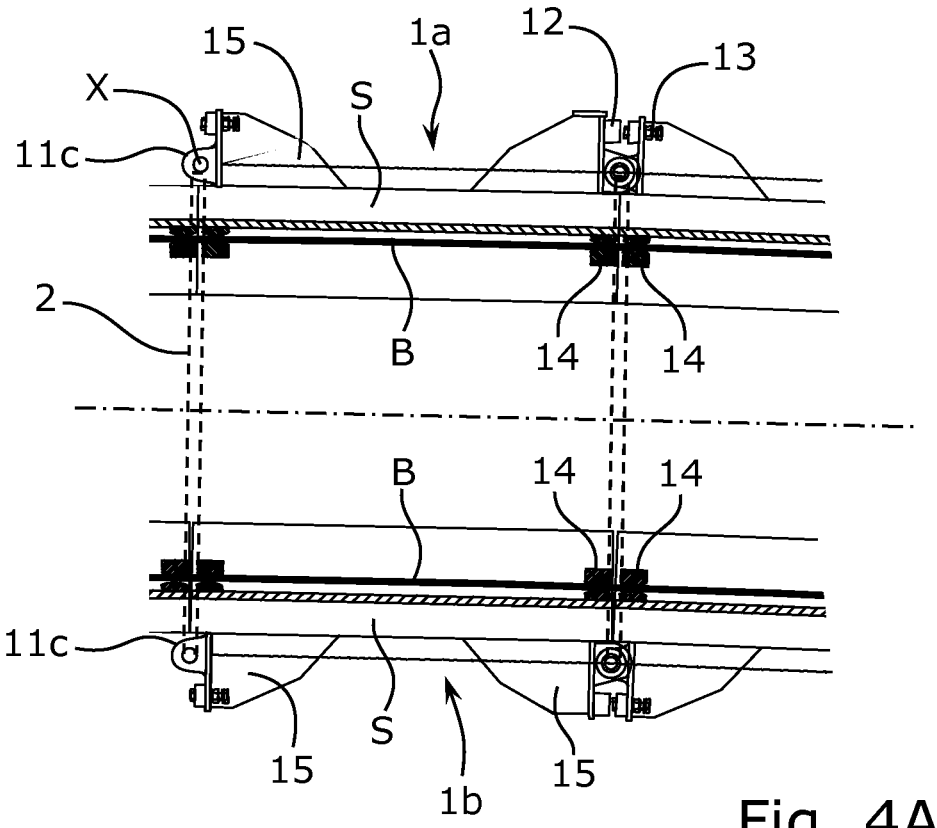
FIGS. 4A and 4B represent partial top views of the invention's track switchgear, respectively, of the ties of two elements and the terminal section of the ties.

The X axis is integral with a pivoting bottom rod 2 which acts as a spacer and ensures both the connection and alignment of two identical switch elements, 1*a* and 1*b*, that are symmetrically arranged on opposite sides of the switch (FIG. 4A).

Preferably, the hinges are mounted on the elements 1 below the level of the upper running face S.

In the embodiment shown in FIG. 3, the hinges comprise, on the one hand, an upper bearing 11*a* together with a lower bearing 11*b* which are vertically aligned and projecting on one of the longitudinal ends of each switch element 1 and, on the other hand, a third bearing 11*c* supported by the other longitudinal end of the element 1. The third bearing 11*c* is inserted between and aligned with the bearings 11*a*, 11*b* opposite the adjacent element 1 the orientation of which is reversed, as shown in FIG. 4A. The X axis thus passes through three bearings.

Each switch element 1 also has a set of longitudinal abutments 12, 13 engaging, on the one hand, with the hinges to adjust the relative angular orientation of the element 1 and with the pivoting bottom rod 2.

The set of abutments includes, on a first longitudinal end of the element 1 (corresponding here to the one on which the bearing 11*c* is located), a pin 13 of variable length and, on a second longitudinal end (corresponding to the one on which the bearings 11*a* and 11*b* are located), a stud 12 intended to support the pin 13 opposite the adjacent switch element 1 of the same tie, as shown in FIG. 4A.

Preferably, longitudinal abutments 12, 13 extend substantially tangentially and at mid-height on the radially outer side of the element 1 beyond the upper running surface S and beyond the bearings 11*a*, 11*b*, 11*c* of the hinges, as shown in FIG. 3.

Figure 2B:
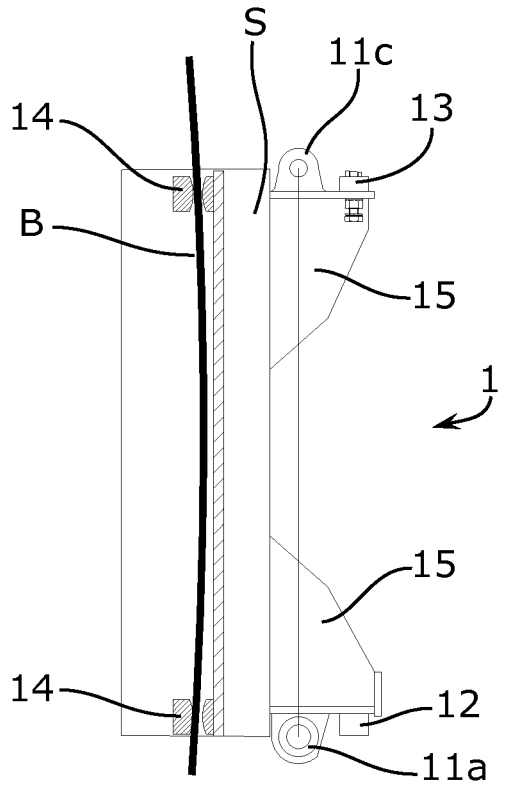

In addition, the switch element 1 has two cleats 14 for retaining the continuous guiding strip B, which, with its inner side face I, provide an intermediate space wherein the curved concave part of the strip B is accommodated when the tie of hinged elements 1 is pivoted in the radially inner direction, as shown in FIG. 2B.

The strip B extends in one piece vertically and along the entire length of the track switchgear by clamping the ties of switch elements 1. Although retained by the cleats 14, the strip B, which is flat at rest, deforms, when the switch is operated, into a concave (element 1*a*,FIG. 4A) or convex (element 1*b*, FIG. 4A) curvature, depending on the pivoting direction of the ties.

The outer side face of the element switch 1 has substantially horizontal fins 15 designed to abut against the markers K on the outer edges of the track, so as to limit ties travel, as shown in FIGS. 3, 5A-5B and 6A-6B.

Figure 4B:
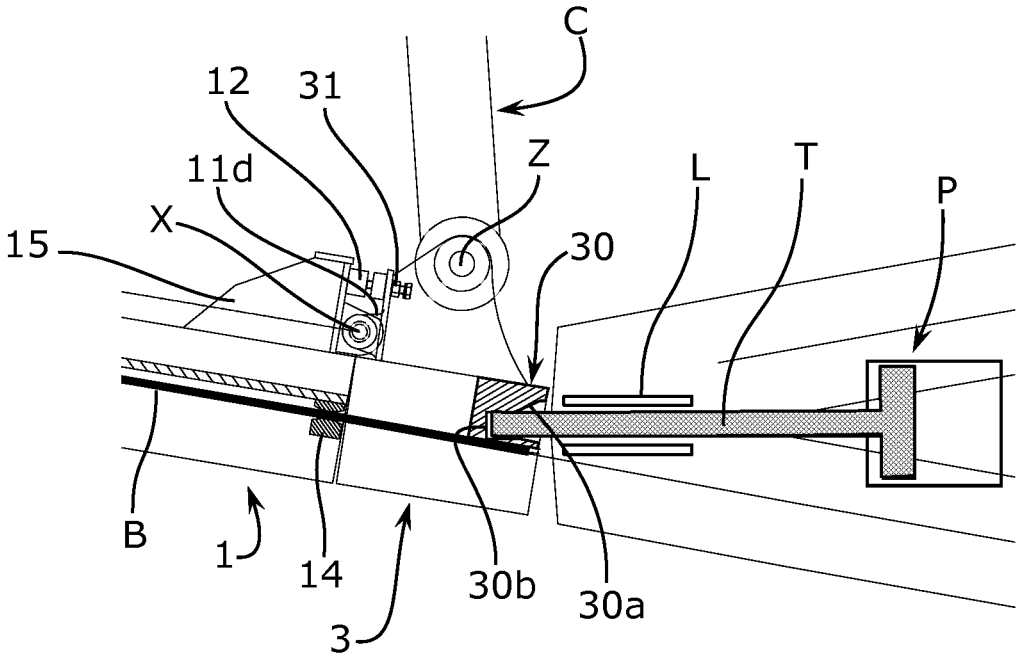

The flexible track switchgear, according to the invention, thus consists of two parallel ties of hinged switch elements 1 as described above, each with a terminal section 3 for connecting with the guard rails at the crossing of the tracks, as illustrated, in particular, by FIG. 4B.

The end sections 3 are hingingly mounted on the switch elements 1 at the ends of the ties and ensure, on the one hand, the joint alignment and locking of the two ties with the crossing guard rails and, on the other hand, the link with devices C for controlling the pivoting of these ties.

The control devices C preferably consist of hydraulic or electric cylinders coupled to linking arms hinged like a pantograph.

To this end, each of the end sections 3 has, on its outer side edge, a pivot Z having a vertical axis connected to one of the arms of the devices C for controlling the pivoting of the ties and, on its rear longitudinal edge, a hinge 11*d* and one abutment 31 engaging, respectively, with one of the hinges 11*a*, 11*b* and one of the abutments 12 of the switch elements 1 located at the ends of the ties, as shown in FIG. 4B.

With this configuration, the switching operation of the track switchgear is carried out by activating the control devices C, which act by pulling or pushing on the end sections 3 of the two ties by moving, in one direction or the other, all the hinged switch elements 1, as shown in FIGS. 5A, 5B and 6A, 6B.

The flexible ties of the elements 1 can thus take two extreme positions of curvature represented, respectively, in FIGS. 5A, 5B and 6A, 6B which correspond to the passage of the train V on one track of the crossing or the other. These two switch positions are defined, on the one hand, by the prior adjustment of the abutments 13 and, on the other hand, by the engagement between the fins 15 of the elements 1 and the fixed markers K of the track.

The alignment of the two ties of switch elements 1 is then maintained by the action of the rods 2 which are connected at their ends to the hinges of the switch elements 1 (see FIGS. 1 and 4A).

To ensure secure locking of the ties linking with the crossing guard rails, each of the end sections 3 is provided with a cavity 30 intended to receive and lock the end of the rod T of different pistons P mounted on the crossing guard rails (of which only the piston of the core of the crossing is shown in FIG. 4B). The cavity 30 is formed by a flared inlet portion 30*a* for the introduction of the rod T and extends inwardly in the form of a blind portion 30*b* having a restricted diameter, wherein the end of the rod T is blocked.

Advantageously, the rod T of the piston P is guided in a conduit L so as to facilitate the positioning thereof opposite the flared portion 30*a* of the cavity 30.

Figure 5A:
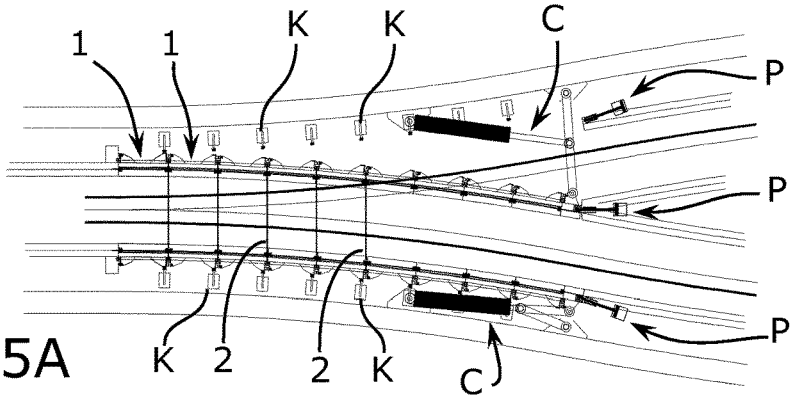
FIGS. 5A and 5B show views of a first alternative embodiment of the invention's switchgear, respectively, in two respective positions of the switch.
Figure 5B:
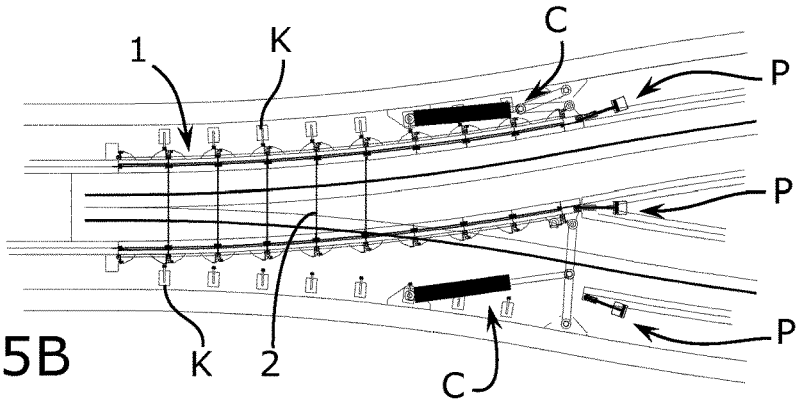

The variant of the invention illustrated in FIGS. 5A and 5B corresponds to a flexible track switchgear wherein each of the two ties comprises nine switch elements 1 and is therefore of great length.

Figure 6A:
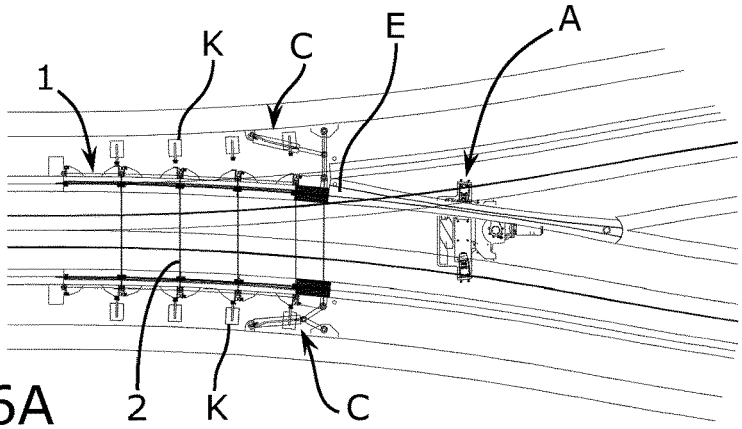
FIGS. 6A and 6B show views of a second alternative embodiment of the invention's switchgear coupled to a traditional central switch rail, respectively, in two respective positions of the switch.
Figure 6B:
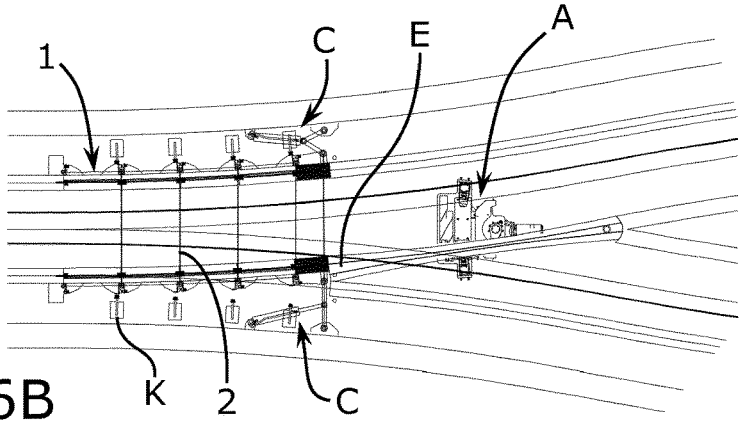

In the variant of the invention illustrated in FIGS. 6A and 6B, the track switchgear consists of ties, each of which comprises only four switch elements 1, and is therefore significantly shorter. In this case, the track switchgear described above is associated with a central switch rail A which is motorized and mounted rotatively in the axial extension of the crossing core. This switch rail A has a traditional structure with a spatulated end branch E alternately aligned with the respective end sections of the two ties. This variant makes it possible to produce switches with larger radii.

The invention claimed is:

1. A flexible track switchgear for equipping a track crossing of a track carrying a rubber-tyred train, the track comprising two parallel rails, each having an upper running face for tyres of the rubber-tyred train and an inner side face for guiding the rubber-tyred train, the switchgear comprising two parallel ties of switch elements, each of the switch elements having at least one hinge providing a longitudinal link with an adjacent switch element of the same one of the two parallel ties, wherein said switch elements each have a set of longitudinal abutments engaging with said at least one hinge for adjusting a relative angular orientation of the switch element and with a pivoting bottom rod providing a connection to an alignment with an identical switch element of the other of the two parallel ties arranged symmetrically on an opposite side of the switchgear, two end sections, each hinged on one of the switch elements located at one end of a respective one the two parallel ties, for aligning and locking the two parallel ties with guard rails of the track crossing and for linking the two parallel ties with devices for controlling a pivoting of the two parallel ties, and a central switch rail rotatively mounted in an axial extension of a crossing core and having a spatulated end branch alternately aligned with the respective end sections of the two parallel ties.

2. The flexible track switchgear of claim 1, wherein for each switch element, said at least one hinge is located at one longitudinal end of the switch element, and the switch element comprises a further hinge located at an opposite longitudinal end of the switch element.

3. The flexible track switchgear of claim 1, wherein each switch element comprises two cleats for retaining the continuous guide strip, which, with an inner side face of the continuous guide strip, provides an intermediate space for accommodating the curved part of said continuous guide strip.

4. The flexible track switchgear of claim 1, wherein the set of longitudinal abutments comprises, at a first longitudinal end, a pin of variable length and, at a second longitudinal end, a stud for receiving a support of the pin opposite the adjacent switch element.

5. The flexible track switchgear of claim 1, wherein said at least one hinge is mounted between an inner side face of the continuous guide strip and the set of longitudinal abutments.

6. The flexible track switchgear of claim 1, wherein said at least one hinge is mounted below the level of the upper running face.

7. The flexible track switchgear of claim 1, wherein for each switch element, an outer side face of the switch element has substantially horizontal fins intended to come into abutment against markers arranged on outer edges of the track.

8. The flexible track switchgear of claim 1, wherein each of said end sections is provided with a cavity for receiving and locking the end of the piston rod of pistons mounted on the crossing guard rails.

9. The flexible track switchgear of claim 1, wherein each of said end sections has, on an outer side edge, a pivot having a vertical axis connected to one of the devices for controlling the pivoting of the ties.

10. The flexible track switchgear of claim 1, wherein each of said end sections has one abutment engaging with abutments of the end switch elements of the ties.

* * * * *